US007925039B1

(12) United States Patent
Griffin

(10) Patent No.: US 7,925,039 B1
(45) Date of Patent: Apr. 12, 2011

(54) CYLINDRICAL CONTROLLER FOR AN ELECTRONIC DEVICE

(75) Inventor: Paul Griffin, Nashville, TN (US)

(73) Assignee: Griffin Technology, Inc., Nashville, TN (US)

( * ) Notice: Subject to any disclaimer, the term of this patent is extended or adjusted under 35 U.S.C. 154(b) by 1245 days.

(21) Appl. No.: 11/521,098

(22) Filed: Sep. 14, 2006

(51) Int. Cl.
*H04R 25/00* (2006.01)

(52) U.S. Cl. ..... 381/384; 381/388; 74/471; 345/161

(58) Field of Classification Search ..... 381/384, 381/388; 345/161, 156; 74/471
See application file for complete search history.

(56) References Cited

U.S. PATENT DOCUMENTS

| | | | | |
|---|---|---|---|---|
| 4,685,678 | A * | 8/1987 | Frederiksen | 345/161 |
| 5,598,090 | A * | 1/1997 | Baker et al. | 322/3 |
| 6,429,849 | B1 * | 8/2002 | An et al. | 345/161 |
| 6,892,481 | B2 * | 5/2005 | Yamamoto et al. | 345/161 |
| 7,400,859 | B2 * | 7/2008 | Dayan | 381/2 |

* cited by examiner

*Primary Examiner* — Suhan Ni
(74) *Attorney, Agent, or Firm* — Jason L. Hornkohl; Hornkohl Intellectual Property Law PLLC

(57) ABSTRACT

A cylindrical controller provides a user interface for an electronic device that is easier to use than conventional controls. The cylindrical body contains a number of sensors that detect when the cylindrical body is rotated between the thumb and finger of a user. The sensors determine whether the rotation is in a clockwise or counter clockwise direction. The present invention allows users to remotely control a consumer electronics device by manipulating a cylindrical body with familiar prehensile gestures, i.e., pinching, squeezing, and rolling.

6 Claims, 5 Drawing Sheets

During previous force, switches 1, 3 + 4 are activated
During current force, switches 3, 5 + 1 are activated.

therefore the cylindrical body is rotating clockwise

CYLINDRICAL CONTROLLER FOR AN ELECTRONIC DEVICE

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

FIELD OF THE INVENTION

The present invention is directed generally toward a pressure sensitive controller for use with an electronic device such as a computer, set top box or portable media player.

BACKGROUND OF THE INVENTION

With the proliferation of portable media players, such as Apple Computer's iPod™, consumers are increasingly consuming audio-visual media content while mobile and on the go. The durability and small form-factor of portable media players make it possible for users to wear such devices discreetly on their bodies, and to do so while moving about in public spaces, commuting, and performing athletic activities. The prospect of users controlling their portable media players while traversing crowded sidewalks, riding subways or trains, jogging, exercising in gyms, etc., presents a challenge to design engineers seeking to provide user friendly human interface devices for controlling these devices.

Remote control devices offer a partial solution to the usability challenges endemic to the control of personal media players. Remote control devices allow users to interact with a control device that is separate from the body of the media player. These remote control devices typically can be carried in hand or attached to the user's body or clothing in a more accessible location than the controls of the portable media player. Nevertheless, currently available remote control devices, most of which rely on mechanical buttons and switches positioned on a planar surface, are still often unwieldy and hard to use. It is unnecessarily cumbersome for typical users to find the correct orientation of such remote control devices, and to do so without sending inadvertent control signals to the portable media player that may cause the device to perform undesirable functions. During athletic activity, it is especially difficult for users to manipulate buttons located on a planar surface that is frequently angled in such as way as to require the user to assume an awkward position or cease their activity to affect the desired control inputs. In addition, these remotes are easy to lose due to their being physically separate from the portable media player itself.

The two prevalent technologies underlying human interface devices for the control or remote control of consumer electronics devices such as portable media players are "mechanical" and "capacitive sensing" controls. Mechanical controls, which rely on traditional mechanical components, have human interface elements such as buttons, knobs, and switches. An example of such a mechanically activated control is the "click button" on Apple Computer's iPod™. Capacitive sensing controls, which rely on a planar array of electronic sensors, are used in human interface elements such as linear sliders and touch wheels. An example of such a capacitive sensing control is the "scroll wheel" on the iPod™. Unfortunately, both mechanical controls and capacitive sensing controls present usability problems, especially in conditions in which users are ambulatory and, thus, only able to pay partial attention to the device controls. This is often the case when the user is involved in urban-pedestrian or athletic activity. Therefore, what is needed is an improved device for controlling consumer electronic devices such as portable media players.

BRIEF SUMMARY OF THE INVENTION

An embodiment of the present invention is directed toward a controller for an electronic device such as an iPod™. The controller has a cylindrical body attached to the electronic device through a cable wherein rotating the cylindrical body produces a signal. The cylindrical body preferably has a series of pressure sensitive sensors positioned around a periphery of the cylindrical body. Alternatively, the cylindrical body may be constructed from at least one outer conductive layer positioned over a compressible conductive material and an inner conductive core positioned within the compressible material. In addition, the cylindrical body may have a first set of sensors positioned on a first location and a second set of sensors positioned on a second location such that a first signal for controlling a first function of the electronic device is produced by gripping and rotating the first portion of the cylindrical body and a second signal for controlling a second function of the electronic device is produced by gripping and rotating the second portion of the cylindrical body. A processor converts the signal into a control signal for the electronic device. The processor is in a coupling body adapted to couple to an output of the electronic device. The electronic device is preferably a digital media player having head phones and the cylindrical body is coupled between the head phones and the digital media player such that rotating the cylindrical body alters a volume output of the headphones.

Another embodiment of the present invention is directed toward an accessory for an electronic device. The accessory includes a cylindrical controller for producing an output signal in response to the cylindrical controller being rotated in a clockwise or counter clockwise direction. A device interface couples the cylindrical controller to the electronic device. The device interface has a microcontroller for converting an output signal of the cylindrical controller into a format readable by the electronic device. The electronic device is preferably a digital media player having head phones and the cylindrical controller is coupled between the head phones and the digital media player such that rotating the cylindrical body alters a volume output of the headphones. The cylindrical controller may include a series of sensors positioned around a periphery of the cylindrical controller or an outer conductive layer positioned over a compressible conductive material and an inner conductive core positioned within the compressible material such that the output signal is related to a resistance between the outer conductive layer and the inner conductive core. In addition, the cylindrical controller may include a first set of sensors positioned on a first location of the cylindrical controller and a second set of sensors positioned on a second location of the cylindrical controller such that a first signal for controlling a first function of the electronic device is produced by gripping and rotating the first portion of the cylindrical controller and a second signal for controlling a second function of the electronic device is produced by gripping and rotating the second portion of the cylindrical controller.

Yet another embodiment of the present invention is directed toward a controller for a digital media player having an audio output. The controller includes a cylindrical body that is not physically mounted on the digital media player. The cylindrical body is coupled between the audio output of the digital media player and at least one speaker such that rotating the cylindrical body in a clockwise or counter clockwise direction alters an audio output of the speaker. A coupling body couples the cylindrical body to the digital media player. The coupling body contains a processor for converting an output of the cylindrical body into a format recognizable by the digital media player. The cylindrical body may include a first set of sensors positioned on an upper portion of the cylindrical body and a second set of sensors positioned on a lower portion of the cylindrical body wherein a first signal for controlling a first function of the digital media player is produced by gripping and rotating the upper portion of the cylindrical body and a second signal for controlling a second function of the digital media player is produced by gripping and rotating the lower portion of the cylindrical body.

DETAILED DESCRIPTION OF THE INVENTION

Figure 1:
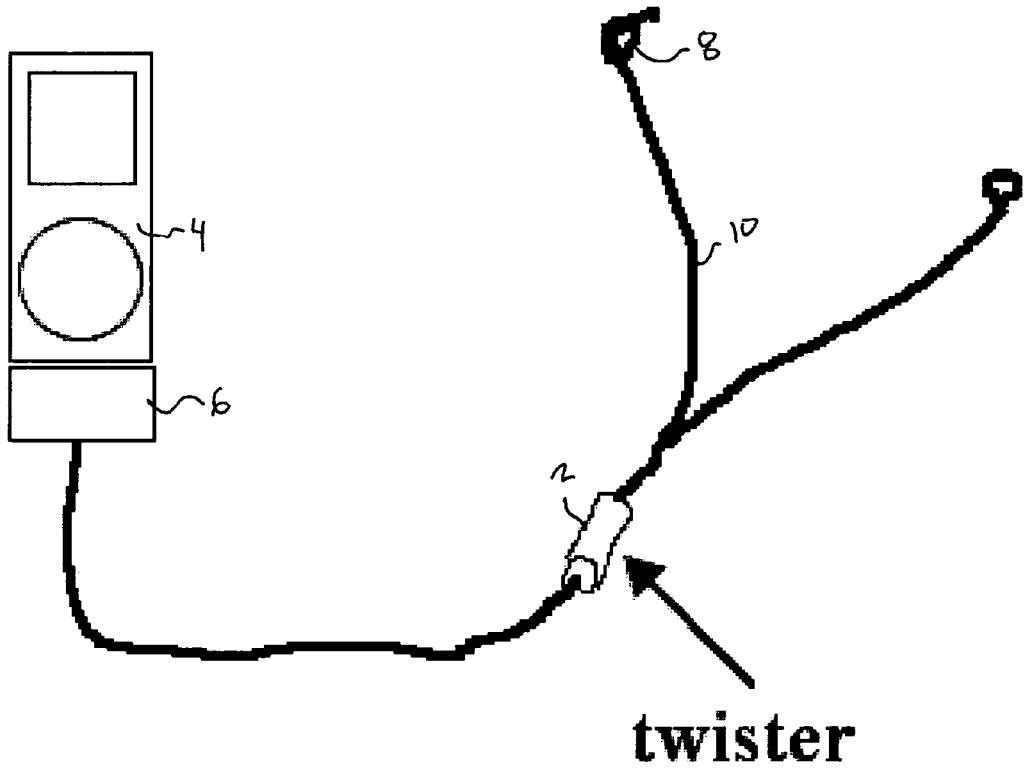
FIG. 1 is an illustration of an embodiment of the present invention coupled to a portable media player.

The present invention is broadly directed toward a rotary device for controlling a consumer electronic device. Referring now to FIG. 1, an illustration of an embodiment of the present invention coupled to a portable media player 4 is shown. The embodiment uses a cylindrical body 2 that acts as a remote control device for a consumer electronic device such as a digital media player 4. The cylindrical body 2 is operatively connected—either wired or wirelessly—to a coupling body 6 that contains a microcontroller and attaches to the consumer electronic device 4. In the embodiment shown, the cylindrical body 2 is connected between the coupling body 6 and a pair of head phones 8 by a set of wires 10. The cylindrical body 2, as discussed in more detail below, preferably has a plurality of sensors located on its periphery such that it is able to accept user inputs by being squeezed and rolled between the user's thumb and at least one finger. The switches or sensors themselves can be of several known types such as conductive foam, capacitive, resistive, optical, momentary, touch screen membrane, etc. The control surface preferably spans 360 degrees around the cylindrical body 2 such that the device 2 can be grasped between the thumb and finger(s) of a user at any orientation. This allows the user to find a comfortable position for manipulating the controls without having to examine the cylindrical body 2. When the cylindrical body 2 pressed between a user's thumb and finger(s), the coupling device 6 registers electrical signals that are encoded into a digital control signal for the portable media player by a microcontroller. The microcontroller may be located inside the coupling body 6, the cylindrical body 4, the speaker or headphone assembly 8, any point in the cable assembly 10 or any other suitable location. The control signals are then transmitted from the coupling device 6 to the portable media player to affect the desired change. Alternatively, the coupling device 6 itself can alter an output signal from the media player 4 to cause the desired change.

Figure 2:
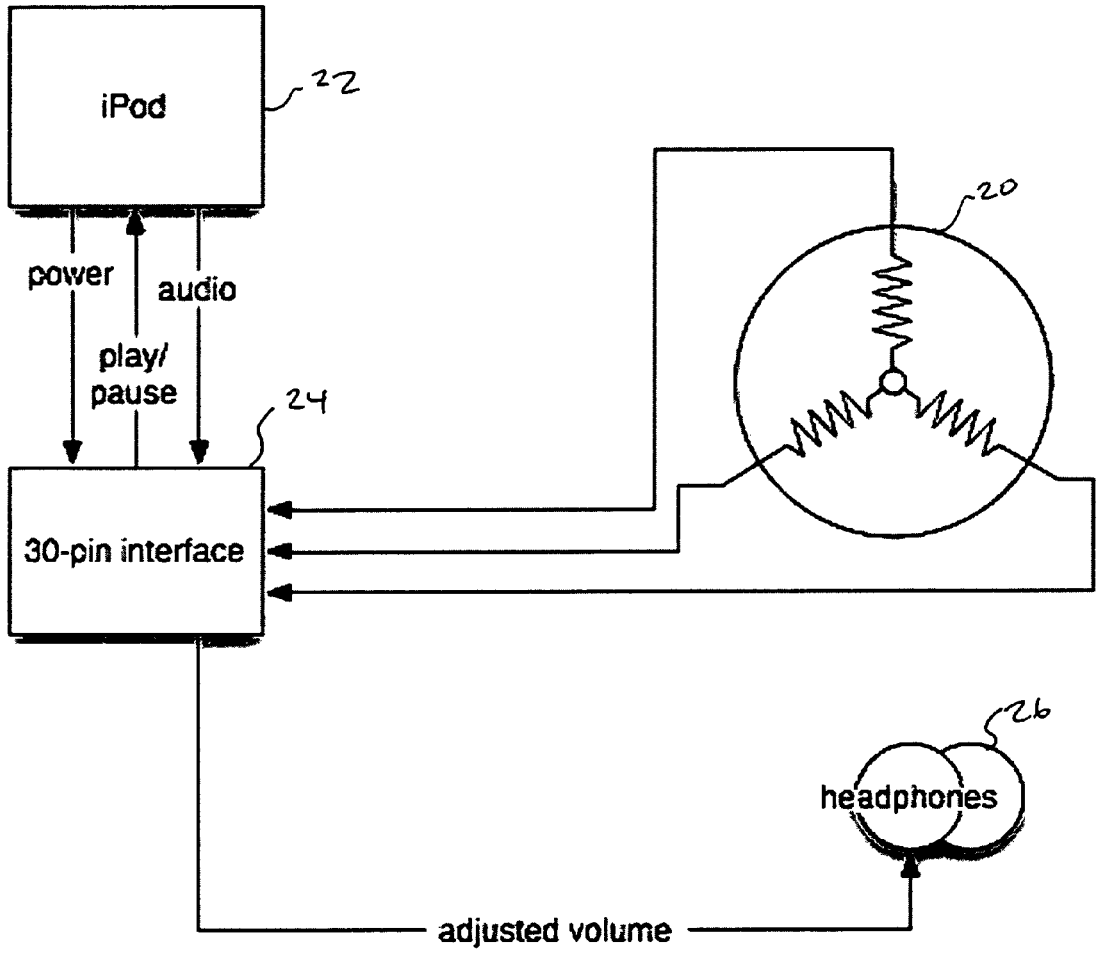
FIG. 2 is a block diagram of an embodiment of the present invention coupled to a portable media player.

Referring now to FIG. 2, a block diagram of an embodiment of the present invention coupled to a portable media player is shown. The cylindrical switch 20 is interfaced with the portable music player 22 through an interface 24. In the example shown, the interface 24 is the thirty pin connector used by the Apple iPod™. However, the interface 24 can be altered as needed to interface the switch 20 to the particular type of device 22 for which it is being designed to be used with. The switch 20 is preferably coupled to the interface 24 such that audio output of the device 22 is controlled by manipulation of the switch 20. This can be accomplished by actually modifying the audio output received from the device 22 or creating control signals that are sent to the device 22 to instruct the device 22 itself to alter its output. The result is that the volume of the headphones 26 is controlled by manipulating the cylindrical switch 20. The switch 20 may also be configured to control other common functions of the device 22 such as power, play, stop, pause, etc. if desired.

Figure 3:
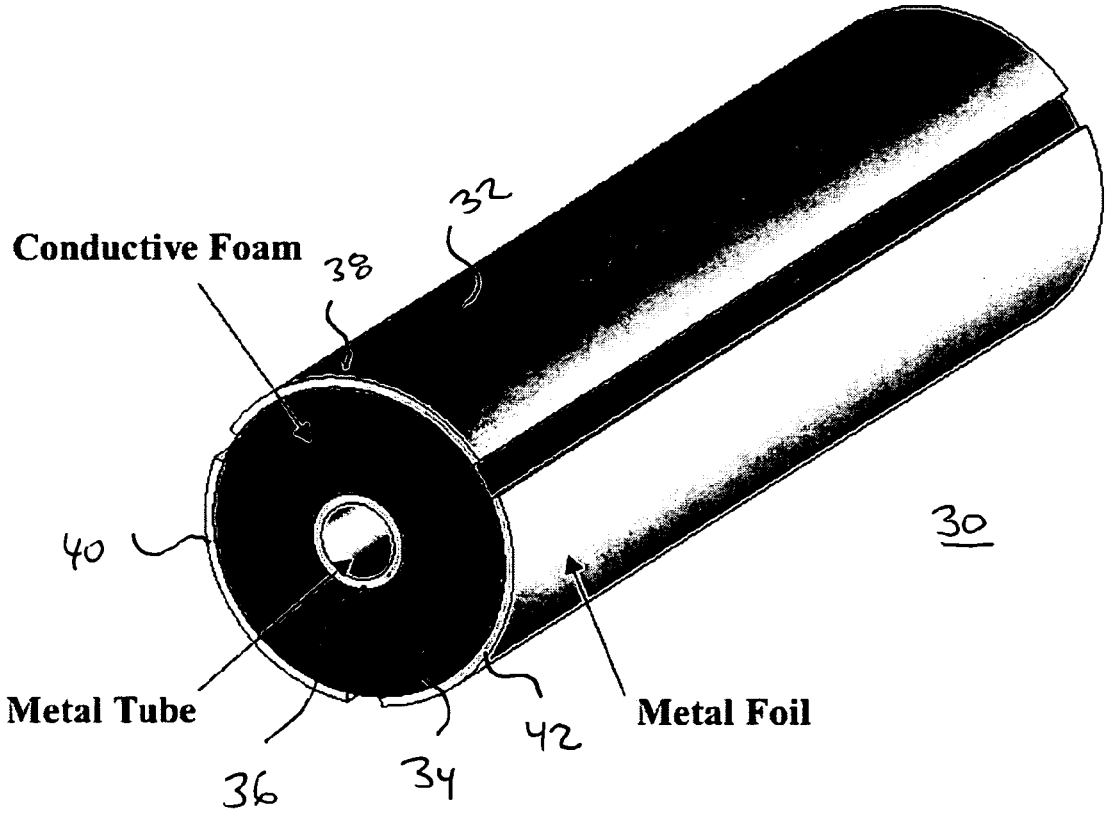
FIG. 3 is an illustration of a pressure sensitive switch constructed in accordance with an embodiment of the present invention.

Referring now to FIG. 3, an illustration of a pressure sensitive, cylindrical switch 30 constructed in accordance with an embodiment of the present invention is shown. The switch 30 shown consists of an exterior metal foil or plate 32 positioned around a conductive foam 34 that surrounds an inner conductive tube 36. The natural resistance of the conductive foam material 34 positioned inside the cylindrical body 30 provides tactile or haptic feedback to a user of the switch 30. The exterior foil 32 is preferably divided into sections 38, 40 and 42 such that different locations on the exterior can be individually monitored. Exterior electrical connections are made to the sections 38, 40 and 42 of the exterior foil 32 and the interior conductive core 36. Electrical signals transmitted through the electrical connections allow a remote processor to determine the resistance between the sections 38, 40 and 42 and the core 36. Squeezing and rolling motions can be used to alter the resistance of the sections and, thus, encode a variety of control signals for use in controlling the device used with the switch 30. For example, the device 30 can be used to adjust the volume of a personal media player by simultaneously squeezing and rotating the cylindrical body 30 between the thumb and fingers. The switch 30 can also be used to activate play/pause and skip-forward/skip-backward functions by pinching and releasing the cylindrical body 30. Up/down volume control can be signaled by comparing the changes in switch's 30 section's 38, 40 and 42 resistance over time as the cylindrical body 30 is rotated clockwise and counterclockwise between the user's thumb and finger or fingers.

Figure 4:
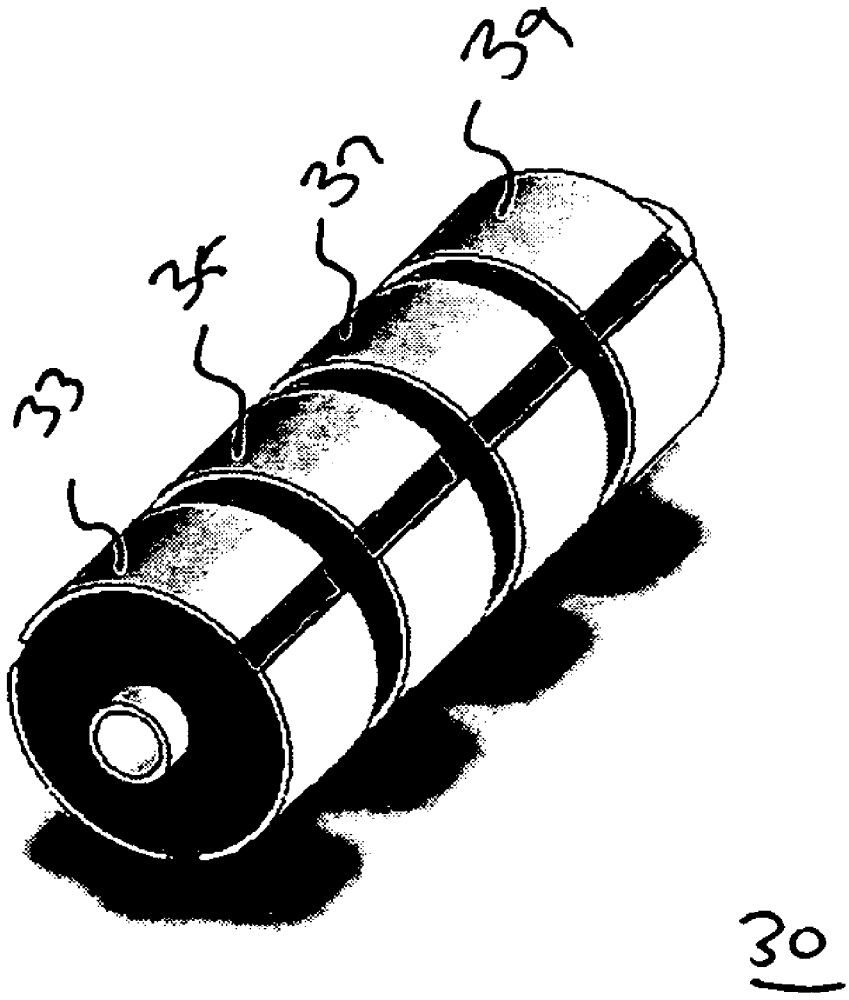
FIG. 4 is an illustration of a pressure sensitive switch constructed in accordance with an embodiment of the present invention having multiple lengthwise sensing sections.

Additional pressure sensitive sensing sections can be placed in different regions along the length of the cylindrical body 30 such that applying pressure to an upper region of the cylindrical body 30 will produce different control signals than those produced by applying pressure to a lower region. For example, as shown in FIG. 4, the exterior foil 32 of the cylindrical switch 30 can be further divided into sections 33, 35, 37 and 39 along its length to create different switch signals depending upon where the cylindrical switch 30 is gripped and rotated along its length. Switch section 33 could be used to alter the volume of a music player, switch section 35 could be used to alter the treble, switch section 37 cold be used to adjust the bass and switch section 39 could be used to control play back and pausing of the player. The actual number of switch sections and the device functions controlled by each section is matter of design choice that will be determined by the particular application for which the switch is designed.

Figure 5:
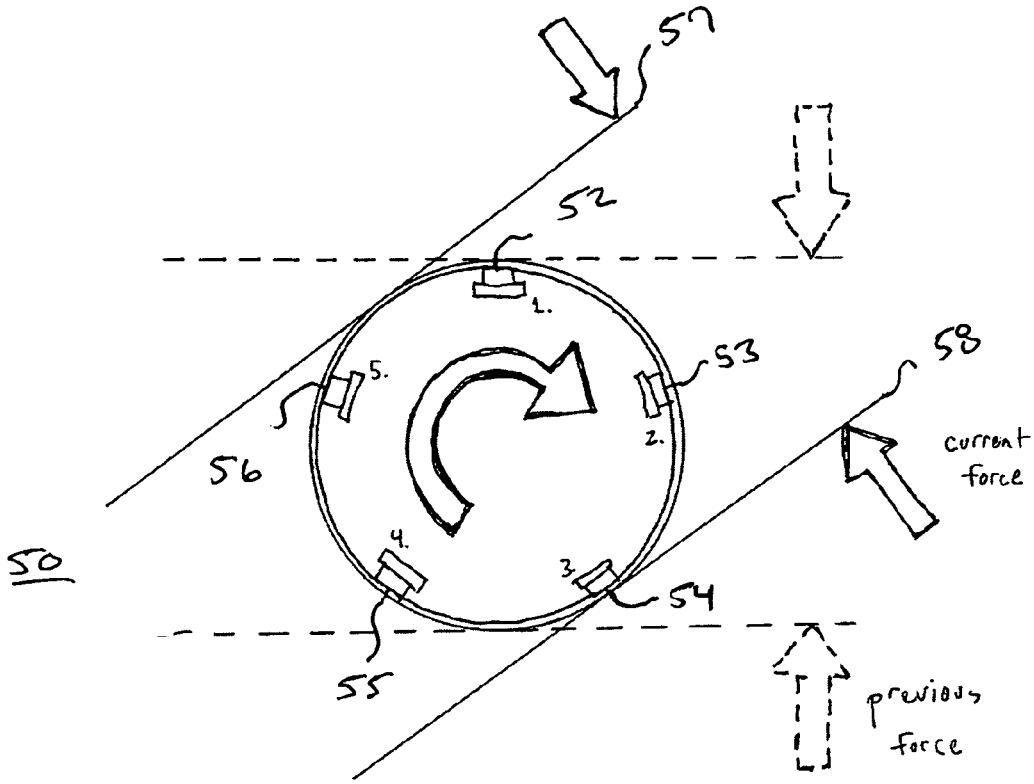
FIG. 5 is an illustration of a pressure sensitive switch constructed in accordance with an alternative embodiment of the present invention.

Referring now to FIG. 5, an illustration of a pressure sensitive switch constructed in accordance with an alternative embodiment of the present invention is shown. In the embodiment shown, a series pressure sensitive switches or sensors 52, 53, 54, 55 and 56, such as piezo electric or capacitive sensors, has been placed around the periphery of the cylindrical controller body 50. While five sensors are shown in FIG. 5, the actual number of sensors in an embodiment need only be two or greater. As the controller body 50 is rotated between the finger and thumb of a user, the particular pressure sensitive switches 52-56 activated over a period of time can be monitored to determine if the cylindrical body 50 is being rotated in a clockwise or counter clock wise direction. For example, if line 57 represents a previously sensed switch activation whereby switches 52, 54 and 55 were activated and line 58 represents a currently sensed switch activation whereby switches 52, 54 and 56 were activated a short period thereafter, it can be concluded that the cylindrical controller is being rotated in a clock wise direction. Additional pressure sensitive sensors can be placed in different regions along the length of the cylindrical body such that applying pressure to the upper region of the cylindrical body will produce different control signals than those produced by applying pressure to the lower region. Thus, the top portion of the cylindrical body 50 may control volume wherein the bottom portion controls play/pause.

A variety of different encoding schemes can be used to convert the output signals of the sensors or switches discussed herein into control signals for electronic devices. For example, the processor monitoring the sensor output can determine the rotational speed of the rotation by measuring a time interval between activation of the switches and convert a faster ¼ turn of the cylindrical body into a larger increase in the volume of the device than a slower ¼ turn of the of the cylindrical body. In a similar manner, in embodiments using pressure sensitive sensors, pressing harder on the sensors can result in a greater increase in the volume than a lighter pressing of the sensors. In such an embodiment, the output of the pressure sensitive switches may be a continuous analog output representing the pressure applied to the sensor or a series of discrete steps represented digitally. Pressure thresholds will correspond to rates of volume increase in accordance with a predetermined schedule.

Although there have been described particular embodiments of the present invention of a new and useful CYLINDRICAL CONTROLLER FOR AN ELECTRONIC DEVICE herein, it is not intended that such references be construed as limitations upon the scope of this invention except as set forth in the following claims.

What is claimed is:

1. A controller for an electronic device, said controller comprising:

a cylindrical body having a plurality of sensors or switches positioned around an outer circumference of said cylindrical body wherein rotating said cylindrical body between a user's fingers activates a subset of said plurality of sensors or switches positioned around said outer circumference of said cylindrical body and produces a signal indicative of a direction of rotation of said cylindrical body; and a processor for converting said signal into a control signal for said electronic device.

2. The controller of claim 1 wherein said electronic device further comprises a digital media player having head phones and said cylindrical body is coupled between said head phones and said digital media player with a cable and wherein rotating said cylindrical body alters a volume output of said headphones.

3. The controller of claim 1 wherein said processor is in a coupling body adapted to couple to an output of said electronic device.

4. The controller of claim 1 wherein said cylindrical body further comprises a first set of sensors or switches positioned on a first outer circumference of said cylindrical body and a second set of sensors or switches positioned on a second outer circumference of said cylindrical body wherein a first signal for controlling a first function of said electronic device is produced by gripping and rotating said first portion of said cylindrical body and a second signal for controlling a second function of said electronic device is produced by gripping and rotating said second portion of said cylindrical body.

5. The controller of claim 1 wherein said plurality of sensors or switches further comprises at least one outer conductive layer positioned over a compressible conductive material and an inner conductive core is positioned within said compressible material that detect a position of said user's finger on said cylindrical body.

6. The controller of claim 1 wherein said plurality of sensors further comprises a series of pressure sensitive sensors positioned around said outer circumference of said cylindrical body and said control signal varies depending upon an amount of pressure applied to said sensors.

* * * * *